US007624464B2

(12) United States Patent
Gladney et al.

(10) Patent No.: US 7,624,464 B2
(45) Date of Patent: Dec. 1, 2009

(54) TITANIUM MATTRESS MEMBER

(75) Inventors: Richard F. Gladney, Fairburn, GA (US); Robert Hellyer, Roswell, GA (US)

(73) Assignee: Dreamwell, Ltd., Las Vegas, NV (US)

( * ) Notice: Subject to any disclaimer, the term of this patent is extended or adjusted under 35 U.S.C. 154(b) by 0 days.

(21) Appl. No.: 10/958,386

(22) Filed: Oct. 4, 2004

(65) Prior Publication Data

US 2005/0108826 A1 May 26, 2005

Related U.S. Application Data

(63) Continuation of application No. 10/268,747, filed on Oct. 10, 2002, now Pat. No. 6,799,344.

(51) Int. Cl.
*A47C 23/00* (2006.01)

(52) U.S. Cl. ..... 5/701; 5/652; 5/727; 5/740

(58) Field of Classification Search ..... 5/652, 5/727, 740, 655.9
See application file for complete search history.

(56) References Cited

U.S. PATENT DOCUMENTS

| | | | | |
|---|---|---|---|---|
| 4,180,877 | A | 1/1980 | Higgins | |
| 4,515,866 | A | 5/1985 | Okamoto et al. | |
| 6,292,965 | B1 * | 9/2001 | Gambrell | 5/716 |
| 6,800,367 | B2 * | 10/2004 | Hanyon et al. | 428/364 |
| 6,984,596 | B2 * | 1/2006 | Dickerson | 442/316 |

* cited by examiner

*Primary Examiner*—Fredrick Conley
(74) *Attorney, Agent, or Firm*—Ropes & Gray LLP

(57) ABSTRACT

A versatile support member constructed of a metallic mesh is provided in a bedding product. The support member is placed on top of the mattress core (whether foam or spring coil) before the mattress cover is attached. The support member may be constructed of titanium wire in a woven or welded mesh grid or web configuration, although other metals (such as, but not limited to, vanadium, chromium, platinum, molybdenum, nickel, iron, zinc), alloys thereof, or fiber composites (such as, but not limited to, carbon or graphite) may be used. The support member may be directly attached to the core or may be secured to the upper or lower border rods by hog rings, stitching, lacing, or other conventional means.

8 Claims, 2 Drawing Sheets

TITANIUM MATTRESS MEMBER

CROSS-REFERENCE TO RELATED APPLICATIONS

This application is a continuation of U.S. application Ser. No. 10/268,747 filed Oct. 10, 2002, now U.S. Pat. No. 6,799,344, the specification is herein incorporated by reference.

BACKGROUND OF THE INVENTION

1. Field of the Invention

This invention relates to bedding products (including but not limited to mattresses) and in particular to bedding products having multiple firmness zones.

2. Description of the Related Art

Traditional bedding or seating products have either an inner spring core comprising a plurality of identically configured coil springs arranged in linear columns and rows or an inner spring core comprising a plurality of pocketed coils, also arranged into columns and rows. When such a spring core is used, it is typically covered with a pad or other covering material that surrounds and envelops the spring core. Sometimes, in the case of a bedding product, an additional padding layer known as a "topper" is attached to the top sleeping surface. A topper may also be attached to the bottom sleeping surface as well, so that the mattress can be flipped.

Traditional bedding or seating products typically have one degree of firmness throughout because all of the springs of the spring core are identical.

Alternatively, bedding and seating systems may have a resilient foam core. This foam core may be surrounded by perimeter bolsters, located around the edges of the sleeping or seating surface, i.e., at the head, foot, or sides of a mattress as those terms are known in the art. Foam core mattresses may also include toppers, in addition to a cover.

Also known in the art are bedding or seating products that have increased firmness in certain regions of the sleeping surface, such as about their perimeter edge portions or in the lumbar region. In particular, lumbar support schemes have included coils or foam elements within the core of different stiffness/resiliency from those employed in other regions of the mattress.

Present core systems add to the complexity of mattress assembly by requiring determination of desired firmness prior to core manufacturing. Also, once a core is assembled with a particular lumbar stiffness, it cannot be readily changed.

What is needed is an easily installed, versatile support member that can be placed in a desired sleep surface region late in the manufacturing cycle, so as to simplify the process and reduce costs.

SUMMARY

A versatile support member constructed of a metallic mesh, in some embodiments, is provided in a bedding product. The support member is placed on top of the mattress core (whether foam or spring coil) before the mattress cover is attached. The support member may be constructed of titanium wire in a woven or welded mesh grid or web configuration, although other metals (such as, but not limited to, vanadium, chromium, platinum, molybdenum, nickel, iron, zinc) or alloys thereof may be used. Fiber composites, such as carbon or graphite, may also be used.

The support member is conventionally sized in width (here defined as the dimension running along the length of the mattress) according to the area to be supported. Its length (here defined as the dimension running across the width of the mattress) is selected according to the size of the mattress, e.g., King, Queen, Twin, etc. The support member may be directly attached to the core at the ends of its length or may be secured to the upper or lower border wires by hog rings, stitching, lacing, gluing, or other conventional means. In mattresses lacking border wires, such as all-foam or foam rail systems, the support member may be attached to the foam core itself, or sewn into the cover.

BRIEF DESCRIPTION OF THE DRAWINGS

The present disclosure may be better understood and its numerous features and advantages made apparent to those skilled in the art by referencing the accompanying drawing.

The use of the same reference symbols in different drawings indicates similar or identical items.

DETAILED DESCRIPTION

Figure 1:
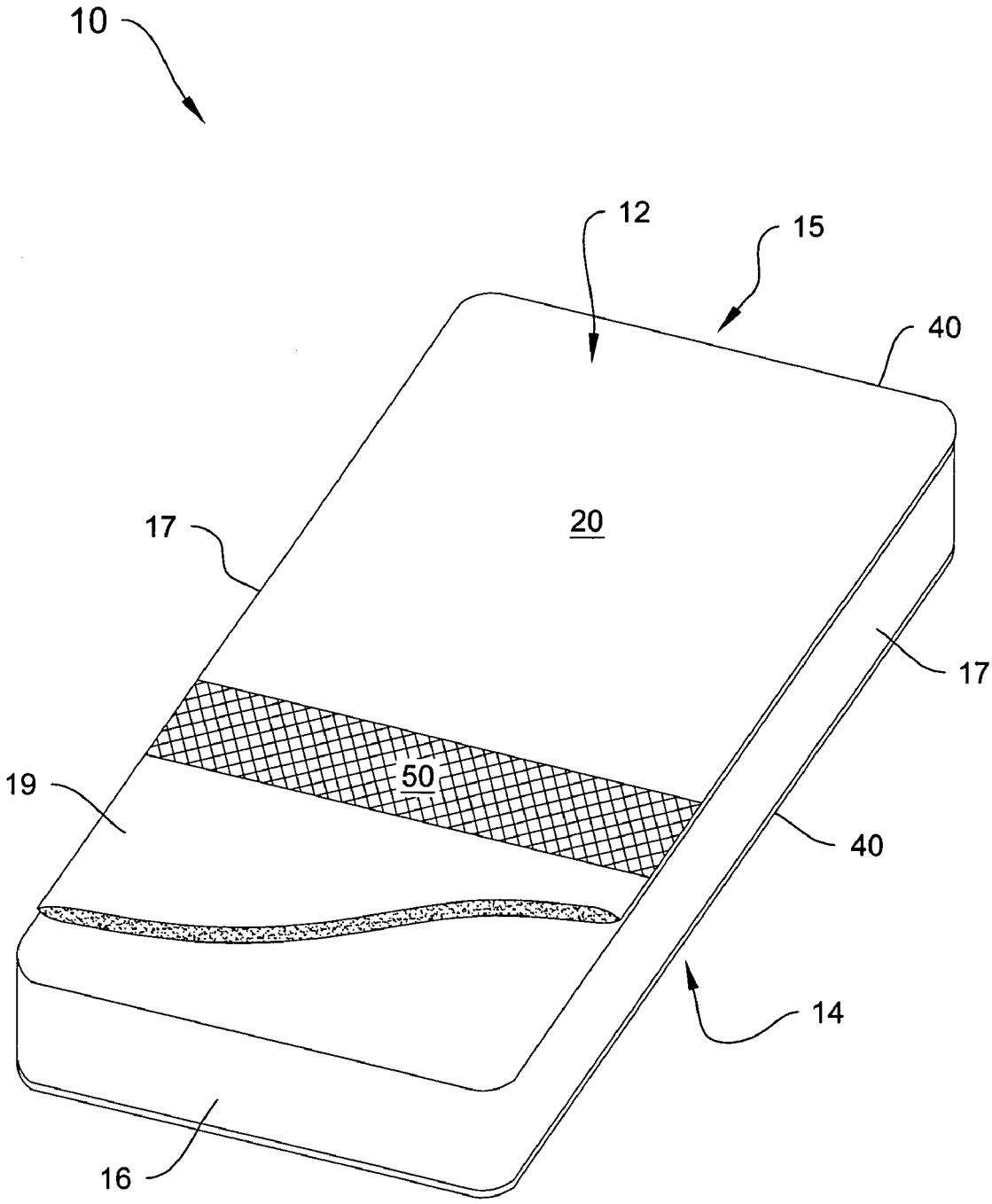
FIG. 1 is an isometric view of a bedding product according to one embodiment of the invention.

FIG. 1 illustrates, in an isometric view, a bedding product generally and in particular a mattress 10 manufactured according to one embodiment of this invention. Mattress 10 consists of a top sleeping surface 12, a bottom sleeping surface 14, a head 15, a foot 16, and two side edges 17. Top sleeping surface 12 and bottom sleeping surface 14 may have a topper 19 attached to each of them. The topper 19 may contain one of more layers of fabric, batting, ticking, foam, and/or coiled springs. When present, the foam layer(s) of the topper 19 may include latex and/or synthetic foam, including but not limited to polyurethane foam.

Although omitted for clarity, the topper may be either permanently or removably attached to sleeping surface 12 and 14. Examples of permanently attached topper, seen in the art, are those that are sewn or bonded onto the mattress cover or those that are encased within a sealed pocket in the mattress cover, yet disposed on the surface of the mattress. Removable toppers are typically attached with a temporary fastener, such as a zipper or hook-and-loop fastener in one or more locations. Either attachment method may be used, or no topper may be supplied.

Mattress 10 may also include a foam core 20 and border wires 40. Foam core 20 is, in some embodiments, a single, monolithic block of a single type of resilient foam selected from foams having a range of densities (themselves well-known in the art) for supporting one or more occupants during sleep. In one embodiment, foam core 20 is made of any industry-standard natural and/or synthetic foams, such as (but not limited to) latex, polyurethane, or other foam products commonly known and used in the bedding and seating arts having a density of 1.5 to 1.9 and 20 to 35 ILD. Although a specific foam composition is described, those skilled in the art will realize that foam compositions other than one having this specific density and ILD can be used. For example, foams of various types, densities, and ILDs may be desirable in order to provide a range of comfort parameters to the buyer.

Border wires 40 may consist of solid rods, 6 gauge wire, helical coils, or a combination thereof. Border wires 40 may also be omitted.

In an alternative embodiment, foam core 20 may comprise one or more horizontal layers of multiple types of foams arranged in a sandwich arrangement. This sandwich of different foams, laminated together, may be substituted for a homogeneous foam block of a single density and/or ILD.

In a further embodiment, foam core 20 may comprise one or more vertical regions of different foam compositions (including vertical regions having multiple horizontal layers), where the different foams are arranged to provide different amounts of support (also referred to as "firmness" in the art) in different regions of the sleeping surface.

In a further alternate embodiment, foam core 20 may be entirely replaced by a conventional coil spring core, comprised of conventional helical or semi-helical springs known and used in the art today. The springs may also be encased in a fabric pocket, either individually, in groups, or pocketed in strings joined by fabric, all of which are well-known in the bedding art.

Accordingly, the invention is not limited to any particular type of foam density or ILD or even to a homogenous density/ILD throughout foam core 20. Furthermore, the invention is not limited to any particular type of core.

Figure 2:
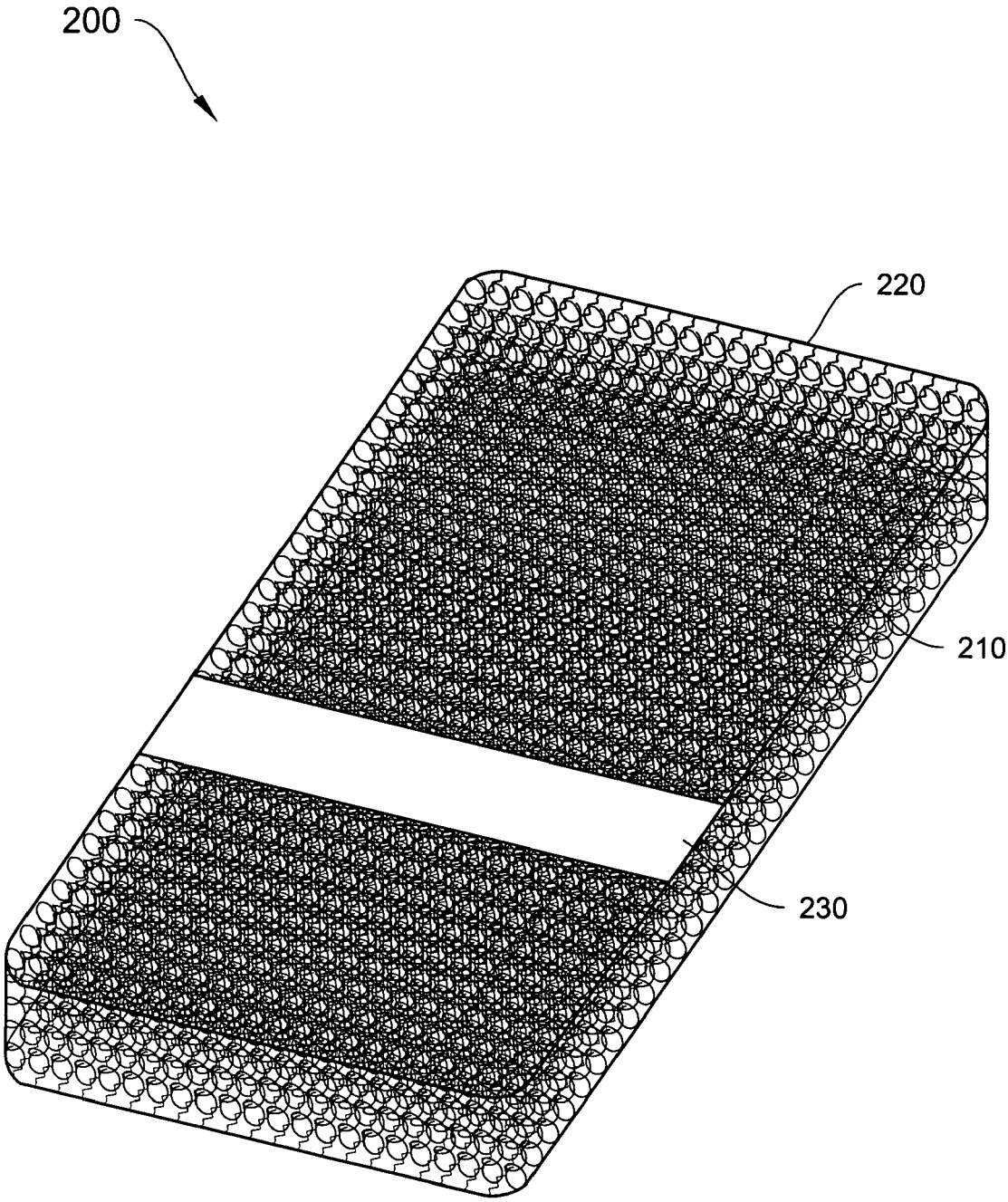
FIG. 2 is a partial isometric view of an inner spring core with a support member consisting of a cloth web interwoven with titanium, according to one embodiment of the invention.

Note also that the mattresses drawn in FIGS. 1 and 2 are not drawn to scale: the overall mattress dimensions typically fall into the ranges commonly found in the trade and referred to, for example, as Twin, Full, King, Queen, Double, etc.

Returning to FIG. 1, border wires 40 of a type and construction well-known in the art are placed at the outer vertices of core 20. Border wires 40 may be used as attachment points for securing foam core 20 (or a spring core) with clips or metal "hog ring" attachment devices currently known and used in the bedding art today. (As noted above, border wires 40 may also be omitted.)

Support member 50 is a metallic mesh material, including but not limited to tape, banding, webbing, open-weave, woven mesh, non-woven fibers, or a welded or stamped grid/mesh configuration. Support member 50 may be attached to border wires 40 at its ends 51 by means of gluing, stitching, lacing, riveting, welding, or by other attachment means currently known or afterwards discovered for attaching fabric-like, planar materials. Alternatively, support member 50 may be attached directly to core 20 by similarly conventional means.

In one embodiment, support member 50 consists of a woven mesh or screen of titanium wire, where the wires are approximately 0.011 to 0.035 inches in diameter and the mesh spacing (i.e., the gap between adjoining wires) is approximately 0.25 inches.

Alternatively, welded grids, rather than woven meshes, may be used for a stiffer feel. The support member could also be stamped or punched from a sheet of metal, leaving a grid or screen pattern.

Non-woven fibers in a plastic or fabric matrix, as well as metal wires or composite fibers (e.g., carbon or graphite) woven with natural or synthetic fibers (e.g., cotton, Kevlar, wool or Nylon cloth) may also be employed. Such a configuration would resemble conventional cloth webbing or banding, but containing (i.e., interwoven with) metal wires or fibers.

FIG. 2 is a partial isometric view of a mattress 200 constructed according to an alternate embodiment. Spring core 210 is shown without cover or embellishment. Note that, as in FIG. 1, spring core 210 may have attached to its perimeter border wire 220. Support member 230 may be attached to border wire 220. In some embodiments, support member 230 consists of a conventional cloth banding material interwoven with titanium fibers or wires.

The diameter of the wires forming the mesh (wire gauge) or diameter of the fibers used, as well as the mesh spacing, may be selected to optimize the stiffness, resiliency, weight, and cost of the product according to the needs of the consumer. Wires or fibers of larger diameter and/or smaller mesh spacing may be selected for increased stiffness, just as smaller diameter wires and/or larger mesh spacing may be chosen for a softer feel. Accordingly, the invention is not limited by the size of the wires or fibers used not their relative spacing.

Support members 50 may consist of a single piece of material or multiple strips of material placed at intervals along the length of the sleeping surface. In an exemplary embodiment, support member 50 is about three to six inches wide, though the exact width depends on the region to be supported. (FIG. 1, by way of example and not limitation, shows a single support element 50 disposed in the lumbar region.)

While particular embodiments of the present invention have been shown and described, it will be apparent to those skilled in the art that changes and modifications may be made without departing from this invention in its broader aspect and, therefore, the appended claims are to encompass within their scope all such changes and modifications as fall within the true spirit of this invention.

We claim:

1. A support member for adjusting a firmness of a sleep surface of a bedding product, comprising:

a fabric matrix made of fibers comprising at least one material selected from the group consisting of composite fibers, natural fibers and synthetic fibers, and elongated members made entirely of metal, said members being woven into said fabric matrix to add firmness to the support member in selected areas of the sleep surface, wherein the elongated members are about 0.011 to about 0.035 inches in diameter, and wherein the fabric matrix and elongated members woven therein are configured to extend continuously across a width of the sleeping surface from a first side surface of the bedding product to a second side surface of the bedding product.

2. The support member of claim 1, wherein said elongated members are at least in part comprised of titanium.

3. The support member of claim 1, wherein said composite fibers are at least in part graphite.

4. The support member of claim 1, wherein the natural fibers comprise cotton and wool, and the synthetic fibers comprise Kevlar and Nylon.

5. The support member of claim 1, wherein a spacing between adjacent elongated members is greater than a spacing between adjacent fibers of the fabric matrix.

6. The support member of claim 1, wherein the elongated members are non-woven wires.

7. The support member of claim 1, wherein the elongated members are single wires.

8. The support member of claim 1, wherein adjacent elongated members are spaced apart by about 0.25 inches.

* * * * *